US006625507B1

(12) United States Patent
Dickerson et al.

(10) Patent No.: US 6,625,507 B1
(45) Date of Patent: Sep. 23, 2003

(54) METHOD AND SYSTEM FOR DESIGNING A LOW PRESSURE TURBINE SHAFT

(75) Inventors: Donna R. Dickerson, Jupiter, FL (US); Gregory E. Chetta, Palm Beach Gardens, FL (US); John J. Marra, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/511,549

(22) Filed: Feb. 23, 2000

(51) Int. Cl.[7] ..... G06F 19/00
(52) U.S. Cl. ..... 700/97; 700/182; 703/1
(58) Field of Search ..... 700/104, 98, 96, 700/97, 103, 117, 182; 703/1

(56) References Cited

U.S. PATENT DOCUMENTS 5,293,479 A * 3/1994 Quintero et al. ..... 345/841
5,455,778 A * 10/1995 Ide et al. ..... 703/1
5,687,094 A * 11/1997 Kagawa et al. ..... 716/5
5,799,293 A * 8/1998 Kaepp ..... 706/45
5,815,154 A * 9/1998 Hirschtick et al. ..... 345/853
5,880,959 A * 3/1999 Shah et al. ..... 700/97
5,966,310 A * 10/1999 Maeda et al. ..... 707/104
5,991,528 A * 11/1999 Taylor et al. ..... 703/6
6,230,066 B1 * 5/2001 Sferro et al. ..... 700/104
6,257,829 B1 * 7/2001 Seeley et al. ..... 415/213.1
6,260,046 B1 * 7/2001 Lukaszewski et al. .. 707/103 R
6,292,763 B1 * 9/2001 Dunbar et al. ..... 703/7

* cited by examiner

*Primary Examiner*—Leo Picard
*Assistant Examiner*—Zoila Cabrera
(74) *Attorney, Agent, or Firm*—McCormick, Paulding & Huber, LLP

(57) ABSTRACT

A method and system for designing a low pressure turbine shaft comprising the steps of creating a low pressure turbine shaft knowledge base of information. The knowledge base has a plurality of design rule signals with respect to a corresponding plurality of parameter signals of associated elements of a low pressure turbine shaft, wherein the knowledge base comprises at least one data value signal for each one of the plurality of design rule signals. The steps also include entering a desired data value signal for a selected one of the plurality of parameter signals of an associated element of the low pressure turbine shaft and comparing the entered desired data value signal for the selected one of the plurality of parameters with the corresponding at least one data value signal in the knowledge base for the corresponding one of the plurality of design rule signals. If the result of the step of comparing is such that the entered desired data value signal for the selected one of the plurality of parameter signals is determined to have a first predetermined relationship with respect to the corresponding at least one data value signal in the knowledge base for the selected one of the plurality of design rule signals, create signals representative of a geometric representation of the selected one of the plurality of parameter signals of the associated element of the low pressure turbine shaft.

44 Claims, 7 Drawing Sheets

METHOD AND SYSTEM FOR DESIGNING A LOW PRESSURE TURBINE SHAFT

CROSS REFERENCE TO RELATED APPLICATIONS

Some of the subject matter disclosed herein is related to the subject matter of commonly owned U.S. patent applications and patents: Ser. No. 09/212,923, filed on Dec. 16, 1998, now abandoned, entitled "Method of Creating a Parametric Model in a CAD System"; U.S. Pat. No. 6,393,331, issued on May 21, 2002, entitled "Method of Designing a Turbine Blade Outer Air Seal"; Ser. No. 09/520,085, filed on Mar. 7, 2000, entitled "Method and System for Designing a Spline Coupling"; Ser. No. 09/517,567, filed on Mar. 2, 2000, entitled "Method and System for Designing an Impingement Film Floatwall Panel System"; and Ser. No. 09/608,620, filed on Jun. 30, 2000, entitled "Method and System for a Frame and Case Engineering Tool". All of the foregoing patent applications and patents are hereby incorporated by reference.

FIELD OF THE INVENTION

This invention relates generally to computer-based methods and system for designing products, and more particularly to a computer-based method and system for designing a low pressure turbine shaft.

BACKGROUND OF THE INVENTION

An aircraft gas turbine engine generally comprises a compression section, a burner section and a turbine section. Each section operates on the working fluid in a well-known manner to generate thrust. The compression section may include a fan, a low pressure compressor and a high pressure compressor. The turbine section may include a low pressure turbine and a high pressure turbine. The low pressure turbine is coupled to a low pressure turbine shaft for driving the fan.

The low pressure turbine shaft is a cylindrically shaped gas turbine engine component which is coupled to the low pressure turbine in one end of the gas turbine engine and extends within the gas turbine engine to the fan located in the air inlet section of the engine. The low pressure turbine shaft is designed to physically and operationally accommodate the surrounding components, such as the compressors, the burners and the turbines. The design of the low pressure turbine shaft must provide space, or clearance, for the other gas turbine engine components during both assembly and operation while meeting performance, weight and durability requirements.

In addition, elements such as an aft-hub and a stub-shaft may be joined to the low pressure turbine shaft. Both the elements and the means of joining must also meet the performance, the weight and the durability requirements.

It is known to design various products using a computer-aided design ("CAD") system, a computer-aided manufacturing ("CAM") system, and/or a computer-aided engineering ("CAE") system. For sake of convenience, each of these similar types of systems is referred to hereinafter as a CAD system. A CAD system is a computer-based product design system implemented in software executing on a workstation. A CAD system allows the user to develop a product design or definition through development of a corresponding product model. The model is then typically used throughout the product development and manufacturing process. An example is the popular Unigraphics system commercially available from Unigraphics Solutions, Inc. (hereinafter "Unigraphics").

In addition to CAD systems, there is another type of computer-based product design system which is known as a "Knowledge-Based Engineering"("KBE") system. A KBE system is a software tool that enables an organization to develop product model software, typically object-oriented, that can automate engineering definitions of products. The KBE system product model requires a set of engineering rules related to design and manufacturing, a thorough description of all relevant possible product configurations, and a product definition consisting of geometric and non-geometric parameters which unambiguously define a product. An example is the popular ICAD system commercially available from Knowledge Technologies, Inc. KBE systems are a complement to, rather than a replacement for, CAD systems.

An ICAD-developed program is object-oriented in the sense that the overall product model is decomposed into its constituent components or features whose parameters are individually defined. The ICAD-developed programs harness the knowledge base of an organization's resident experts in the form of design and manufacturing rules and best practices relating to the product to be designed. An ICAD product model software program facilitates rapid automated engineering product design, thereby allowing high quality products to get to market quicker.

The ICAD system allows the software engineer to develop product model software programs that create parametric, three-dimensional, geometric models of products to be manufactured. The software engineer utilizes a proprietary ICAD object-oriented programming language, which is based on the industry standard LISP language, to develop a product model software program that designs and manipulates desired geometric features of the product model. The product model software program enables the capturing of the engineering expertise of each product development discipline throughout the entire product design process. Included are not only the product geometry but also the product non-geometry, which includes product configuration, development processes, standard engineering methods and manufacturing rules. The resulting model configuration and parameter data, which typically satisfy the model design requirements, comprise the output of the product model software program. This output, from which the actual product may be manufactured, comprises a file containing data (e.g., dimensions) defining the various parameters and configuration features associated with each component or element of the product.

Also, the product model software program typically performs a "what if"analysis on the model by allowing the user to change model configuration and/or parameter values and then assess the resulting product design. Other analyses (e.g., a weight analysis) may be run to assess various model features with regard to such functional characteristics as performance, durability and manufacturability. These characteristics generally relate to the manufacturing and operation of a product designed by the product model software program. They are typically defined in terms of boundaries or limits on the various physical parameters of each product feature. The limits have been developed over time based on knowledge accumulated through past design, manufacturing, performance, and durability experience. Essentially, these parameters comprise rules against which the proposed product model design is measured. The rules generally comprise numbers that define physical design limits or constraints for each physical product parameter. Use of these historically developed parameters, analyses, and design procedures in this way is typically referred to as product "rule-based design" or "knowledge-based design". The rules determine whether the resulting product design will satisfy the component design requirements and whether the design is manufacturable, given various modern manufacturing processes. The rules for a particular product design are pre-programmed into the product model software program for that specific product.

While the ICAD system provides an excellent tool for developing software product models, it is not a replacement for an organization's primary CAD system, which maintains the product model definition throughout the entire product design and manufacturing cycle. This is because the ICAD system is a KBE software development tool rather than a CAD system. For example, while the ICAD system can create a geometric model, it cannot easily create drawings based on that model or support other aspects of the design process typically provided by CAD systems. As such, for the product model created in the ICAD system to be useful throughout the entire product development process, the model must be translated into a CAD system for further manipulation.

Another inherent problem with the commercial ICAD system is that the parametric model created by the product model software program cannot be transported as a similar parametric product model into a Unigraphics CAD system. Instead, the parametric model in ICAD must be transported into Unigraphics as a non-parametric model.

Since design and manufacturing technology is always evolving, the product model imported from the ICAD system into Unigraphics will usually be enhanced with new technology design or manufacturing features. Furthermore, since it is difficult to make modifications to a non-parametric model in Unigraphics, revisions to the product model must normally be made in the ICAD system and re-imported into Unigraphics. This causes any additional features previously added in Unigraphics to be lost.

On the other hand, the Unigraphics CAD system has inherent problems in that not all of the parametric models created by Unigraphics are "standardized"within an organization or industry. Also, parametric models implemented in Unigraphics do not effectively implement a KBE system (similar to the ICAD system) that requires the model configuration and order of Boolean operations to vary according to design requirements. Also, a Unigraphics parametric model cannot be structured to provide parameter relationships that satisfy both design and manufacturing requirements.

As a result, there are instances when a product model developed solely in either the ICAD system or the Unigraphics system will suffice, even with the aforementioned shortcomings. However, there are other instances when it is desired to transport a product model developed in the ICAD system to the Unigraphics CAD system even as a corresponding non-parametric product model.

An object of the present invention is to provide a computer-based method of creating a parametric, three-dimensional, geometric product model of the low pressure turbine shaft system of a gas turbine engine.

Another object of the present invention is to provide a computer-based method of creating a non-parametric product model in a KBE system that can be recreated as a similar product model in a CAD system.

The above and other objects and advantages of the present invention will become more readily apparent when the following description of a best mode embodiment of the present invention is read in conjunction with the accompanying drawings.

SUMMARY OF THE INVENTION

A method for designing a low pressure turbine shaft including the step of creating a low pressure turbine shaft knowledge base of information. The knowledge base has a plurality of design rule signals with respect to a corresponding plurality of parameter signals of associated elements of a low pressure turbine shaft, wherein the knowledge base comprises at least one data value signal for each one of the plurality of design signals. The method includes the steps of entering a desired data value signal for a selected one of the plurality of parameter signals of an associated element of the low pressure turbine shaft and comparing the entered desired data value signal for the selected one of the plurality of parameters with the corresponding at least one data value signal in the knowledge base for the corresponding one of the plurality of design rule signals. The method also includes creating signals representative of a geometric representation of the selected one of the plurality of parameter signals of the associated element of the low pressure turbine shaft if the result of the step of comparing is such that the entered desired data value signal for the selected one of the plurality of parameter signals is determined to have a first predetermined relationship with respect to the corresponding at least one data value signal in the knowledge base for the selected one of the plurality of design rule signals.

A computerized system for designing a low pressure turbine shaft comprises a low pressure turbine shaft knowledge base for storing a plurality of low pressure turbine shaft design parameter signals corresponding to a plurality of design rule signals for creating a geometric representation of a low pressure turbine shaft. The system also includes selection means for receiving a parameter value signal corresponding to at least one of the design parameter signals, and processing means for comparing the parameter value signal with the at least one of the design parameter signals stored in the knowledge base, and means for creating the geometric representation of the low pressure turbine shaft if the parameter value signal has a first predetermined relationship with the design parameter signal and at least one of the design rule signals.

BRIEF DESCRIPTION OF THE DRAWINGS

FIG. 3, which includes

DETAILED DESCRIPTION OF THE PREFERRED EMBODIMENT

Referring to the figures in general, in an exemplary embodiment of the present invention, the invention generally comprises a method and a system embodied in a knowledge-based, product model software program 10 that creates a model 20 of low pressure turbine shaft system 30 of a gas turbine engine 32. The resulting product may then be manufactured from the low pressure turbine shaft system model 20. The product model software program 10 may preferably be embodied in the aforementioned ICAD system, commercially available from Knowledge Technologies, Inc., and operating within a workstation, such as that available from Sun Microsystems or Silicon Graphics. The method and the system of the present invention enables the rapid creation, shaping, sizing and manipulation of a parametric, three-dimensional, geometric model 20 of the low pressure turbine shaft system 30.

Figure 1:
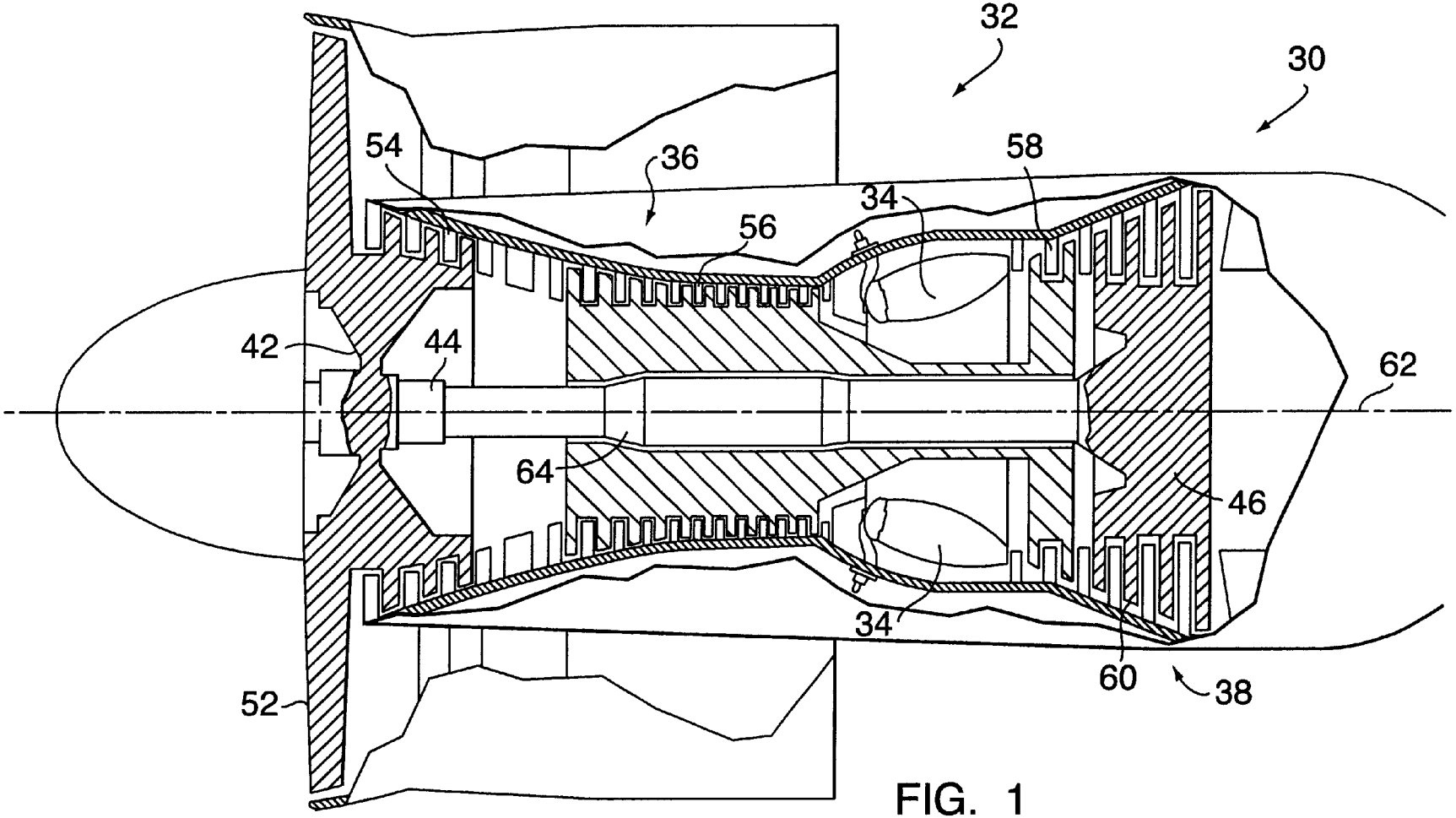
FIG. 1 is a diagrammatic view of a gas turbine engine showing a low pressure turbine shaft and other gas turbine components.

Referring to FIG. 1, the designer of the model 20 of the low pressure turbine shaft system 30 obtains performance and clearance specifications from the designers of the higher level systems, such as burners 34, compressors 36 and turbines 38. In addition, the configurations of some shaft system components, such as a fan-hub 42, a stub-shaft 44, if any, and an aft-hub 46, are determined by the higher level designers prior to the design of the low pressure turbine shaft system 30. Once this information is entered, the product model software program 10 then uses its internal knowledge base of configuration dependent parameter relationships and constraints to create a valid three-dimensional model 20 of the low pressure turbine shaft system 30. The configuration dependent parameters become the default parameters for the low pressure turbine shaft system model 20. The product model software program 10 displays the default parameters, and allows modifications to the parameters and the resulting low pressure turbine shaft system model 20. The configuration default parameters include quantity, position, and dimensions of clearance envelopes and bearings, and position and dimensions of attachment means, such as spline couplings, for shaft system components.

During program 10 operation, the user enters or modifies configuration and parameter data regarding various structural features of the low pressure turbine shaft system 30. This information is typically entered using a keyboard or mouse associated with the workstation. The user is guided by graphical user interfaces ("GUIs") containing information provided on a visual display screen associated with the workstation. The product model software program 10 compares the input design information against a knowledge base of information stored as part of the program. This determines whether any design constraints have been violated which would cause the low pressure turbine shaft system 30 to not satisfy the design requirements or be non-producible using modem manufacturing techniques. If so, the model 20 is invalid.

The stored information comprises a pre-programmed knowledge base of a plurality of configuration dependent parameter relationships and design rules regarding acceptable durability, manufacturing and performance design limits for the low pressure turbine shaft system 30. The visual model 20 may then be manipulated by changing various parameters or attributes associated with corresponding components 40, or associated elements 40, of the low pressure turbine shaft system 30. One of the advantages of the product model software program 10 is that it aids a designer who is familiar with design constraints but who may not be familiar with manufacturing constraints or preferences of a particular company. The designer would have to spend a substantial amount of time looking up and learning a company's manufacturing constraints and preferences, or risk creating a design which could not be built. The product model software program 10 eliminates this time consuming and expensive problem by including the manufacturing constraints and company preferences as part of the knowledge base.

The product model software program 10 also performs a weight report analysis on the low pressure turbine shaft system model 20. Features of the model 20 may be changed, depending upon the results of the analysis. Once creation of a valid model 20 is complete, the product model software program 10 outputs files containing model configuration and parameter data. Other computer programs may then use this output file in a desired manner, such as for further analysis of the model 20. The product model software program 10 also creates a design report and a non-parametric geometric model for use in a CAD system.

FIG. 1 displays the gas turbine engine 32 and illustrates the positioning of the low pressure turbine shaft system 30 and some of the surrounding gas turbine engine components, such as the fan 52 and fan-hub 42, the low pressure compressor 54, the high pressure compressor 56, the burners 34, the high pressure turbine 58, and the low pressure turbine 60. A reference line 62 is shown traversing the axis of the gas turbine engine 32. The low pressure turbine shaft system 30 extends from and couples the fan 52 to the low pressure turbine 60 for driving the fan. The low pressure turbine shaft system 30 includes a long shaft 64 and the aft-hub 46, and may include the stub-shaft 44. In some gas turbine engine 32 configurations, it is not possible to directly connect the fan-hub 42 to the long shaft 64 due to assembly requirements so the stub-shaft 44 is used as an intermediary component to connect the long shaft to the fan-hub. The long shaft 64 and the associated components 40 may be designed using the method of the present invention.

Figure 2:
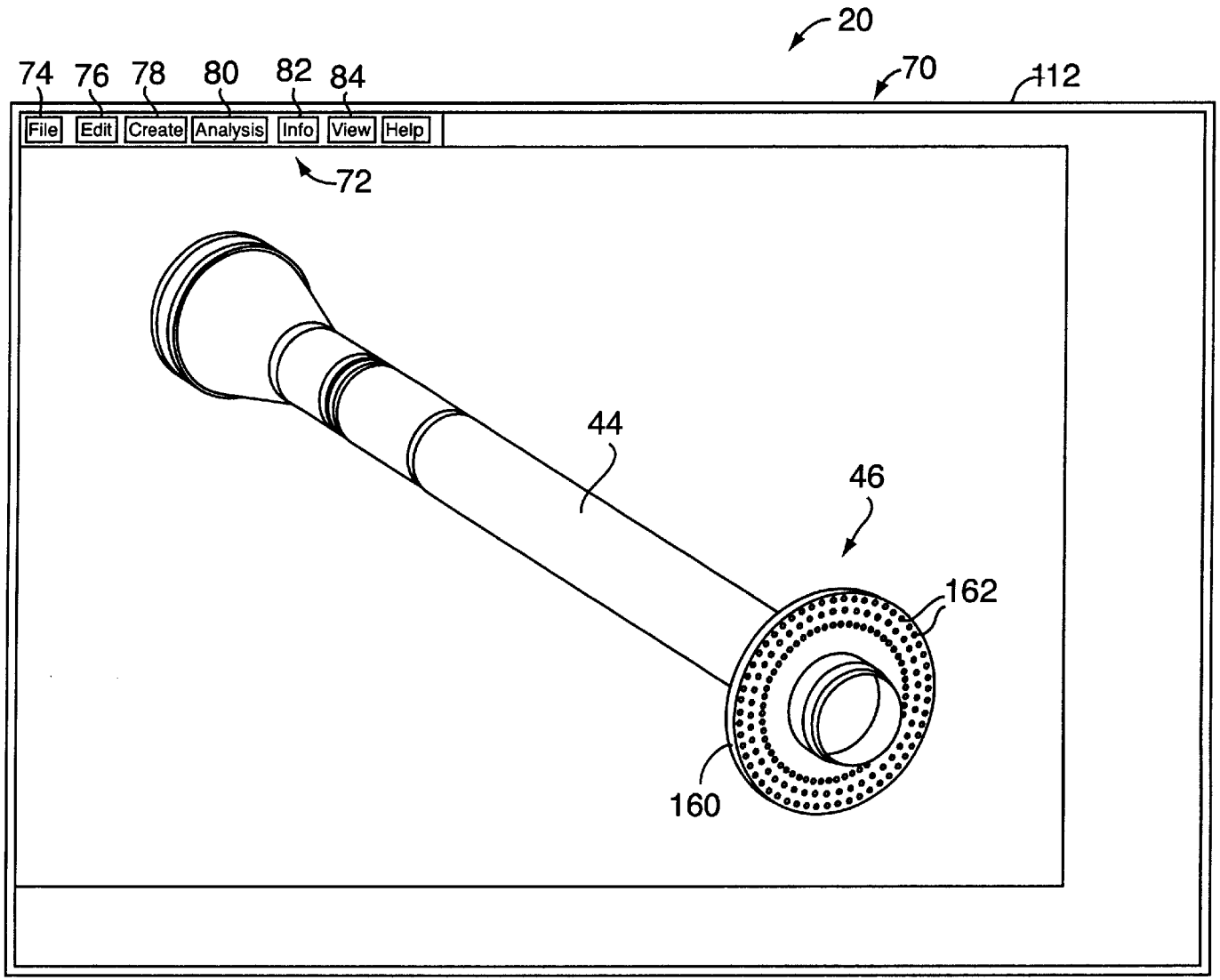
FIG. 2 is an illustration of an exemplary graphical user interface displayed to a user of the product model software program showing a perspective view of a low pressure turbine shaft system.
Figure 3A:
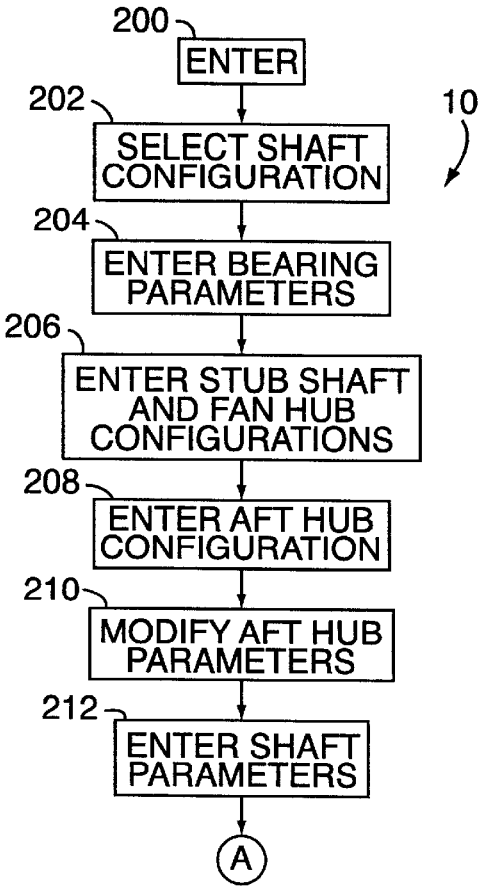
FIGS. 3A–3E, illustrates a flow chart showing one embodiment of steps performed by the product model software program in creating the model of FIGS. 2, 5, 6 and 7, in accordance with the method and the system of the present invention.
Figure 3B:
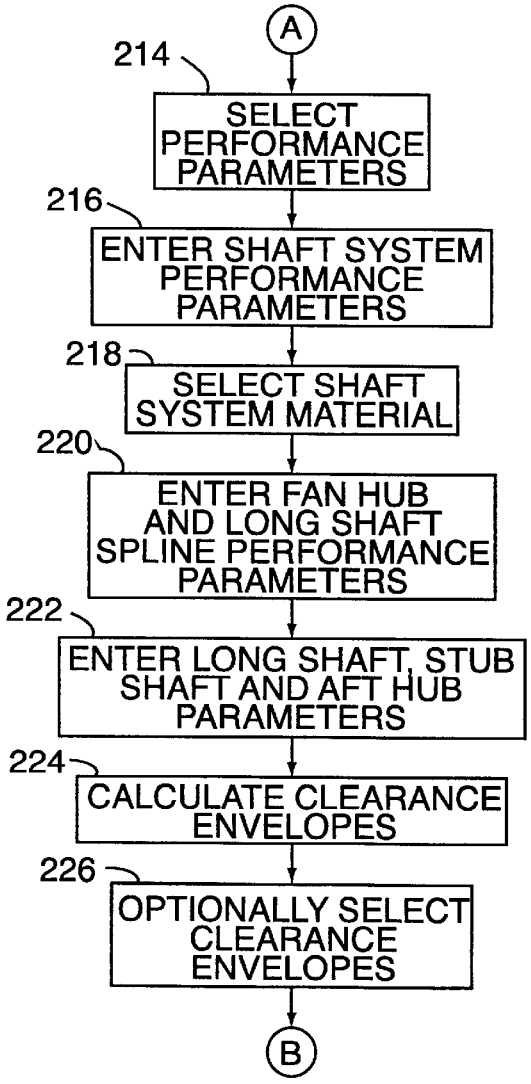
Figure 3C:
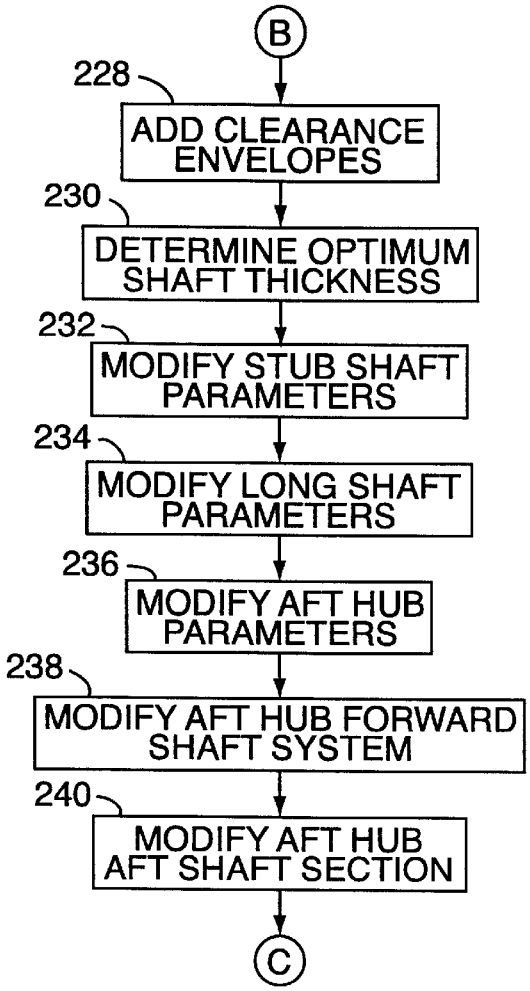
Figure 3D:
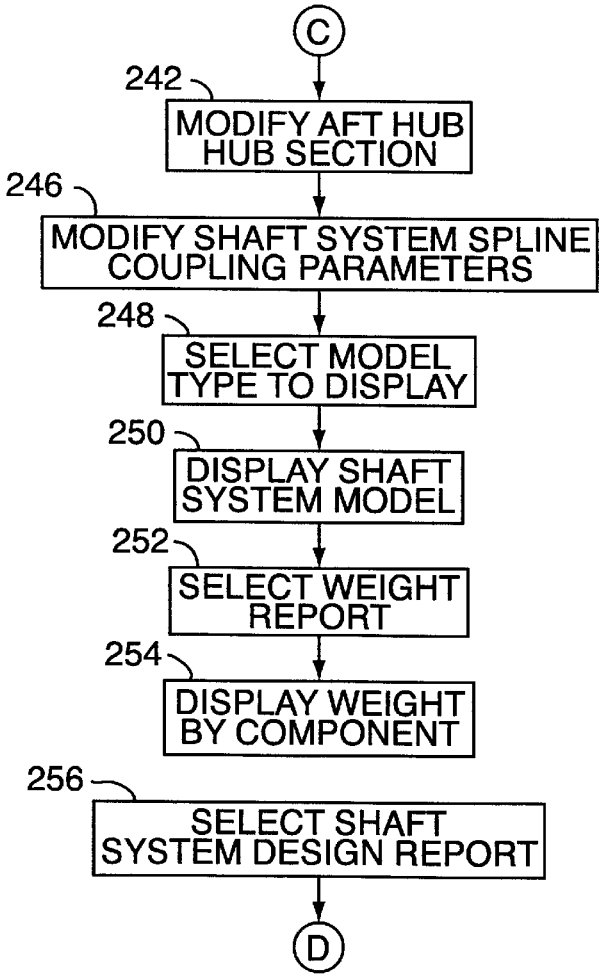
Figure 3E:
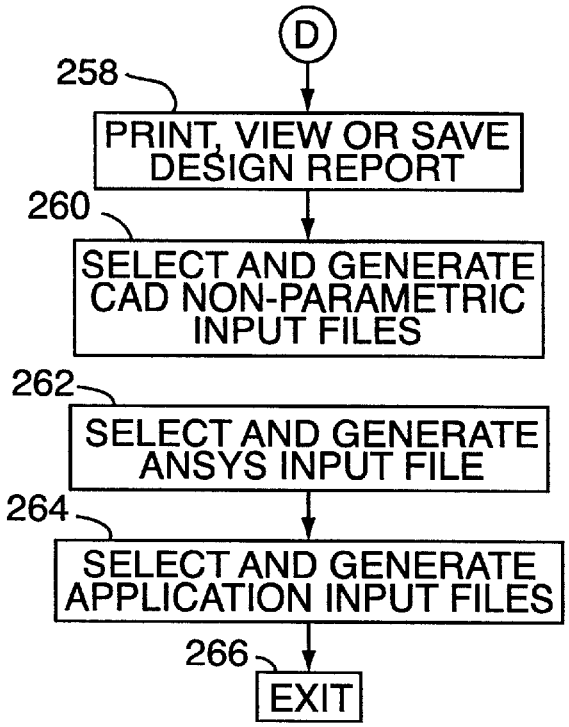

FIG. 2 illustrates a graphical user interface ("GUI") 70 of the present invention and displays a simplified model 20 of low pressure turbine shaft system 30 with an attached stub-shaft 44 and aft-hub 46. Each component of the shaft system model 20 contains a number of distinct physical structural features or forms that may be designed by the product model software program 10, in accordance with an exemplary embodiment of the present invention. Many types of known structural features of the low pressure turbine shaft system are contemplated by the method and system of the present invention, as described hereinafter.

As shown in the GUI screen 70 in FIG. 2, the buttons 72 labeled File 74, Edit 76, Create 78, Analysis 80, Info 82, and View 84, roughly indicate the usual logical steps in the design process for developing the low pressure turbine shaft system model 20. Each of the buttons 72 accesses a drop down menu which invokes at least one additional GUI screen 70 for adding or modifying shaft system model 20 parameters, such as the number of the clearance envelopes. While a logical order to the design process for the low pressure turbine shaft system model 20 has been shown, the present invention is not limited in this regard, as parameters may be modified and input in numerous different orders.

Continuing with FIG. 2, when a rule derived from the knowledge base has been violated, a warning is issued to identify the parameters which have violated the rule. The parameter is highlighted in red to draw immediate notice. A warning may be ignored since the existence of a warning does not require a change to the model, but instead merely indicates that a rule has been broken. The warning may be cleared, corrected, or ignored. The product model software program 10 provides a continual overall evaluation of the low pressure turbine shaft system model 20. A modification to one parameter of the shaft system model 20 may cause a violation of a rule and the triggering of a warning in regard to another parameter of the shaft system model. The user is immediately notified, and can take corrective action, if desired.

Figure 4:
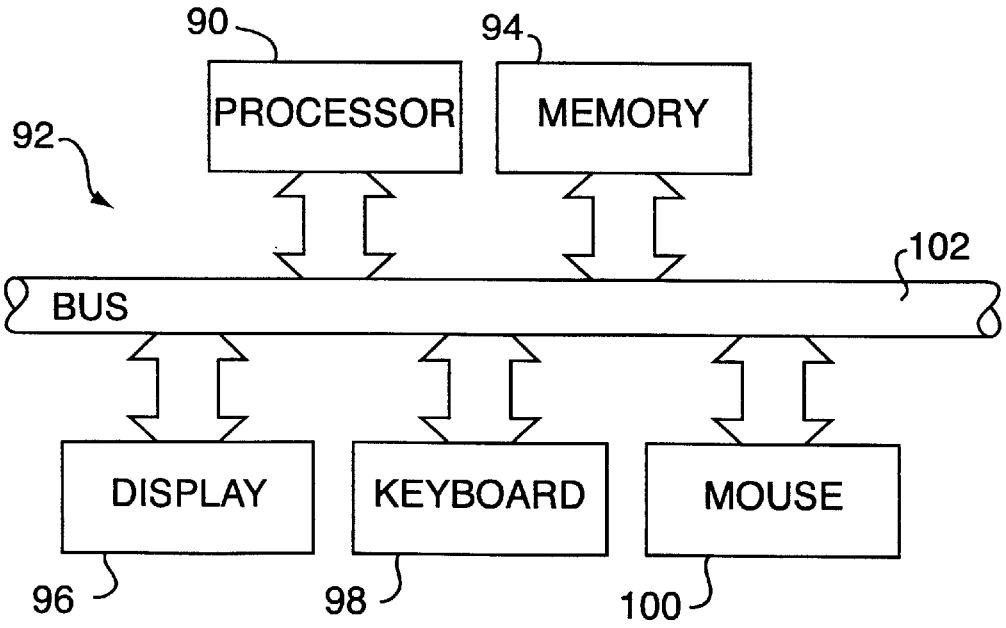
FIG. 4 is a block diagram of a workstation within which the program of FIG. 3 is implemented.

FIGS. 3A to 3E are a flow chart of steps performed by an exemplary embodiment of the product model software program 10 in creating the low pressure turbine shaft system model 20. The program code is preferably written in the proprietary ICAD object-oriented programming language, which is based on the industry standard LISP language. The program code executes on a computer processor 90 within a workstation 92, such as that illustrated in FIG. 4. The workstation 92 may also contain a memory 94 for storing program code and calculated data, a visual display screen 96 for displaying various information to the user along with the low pressure turbine shaft system model 20 after it has been created, and a keyboard 98 and a mouse 100 that are both used to input information to the processor 90 and memory 94. These various devices are connected together by a bus 102.

The product model software program 10 consists of signals stored on a computer system, such as the workstation 92, which are processed by the processor 90 of the workstation. The low pressure turbine shaft knowledge base included within the product model software program 10 are also signals stored on the computer system, as are the specifications and parameters stored within the knowledge base, and the geometric representations and the low pressure turbine shaft system model 20 created by the product model software program. Some signals are displayed to the user, such as warning signals or signals representing parameters or geometric representations of the low pressure turbine shaft. Parameters are a variable or an arbitrary constant appearing in a mathematical expression or a computer program, each value of which restricts or determines the specific form of the expression. A parameter is broader and more general than a specification. A specification is a entry or variable prescribing materials, dimensions, and workmanship for something to be built, installed, or manufactured. Specifications are a subset of parameters. A rule is a relationship between parameters or parameter values, including specifications, such as maximizing the design parameter signals representing diameters of the low pressure turbine shaft relative to the design parameter signals representing clearance specifications. Parameter values may be predefined in the low pressure turbine shaft knowledge base or entered by a user.

Continuing with FIGS. 3A to 3E, after an enter step 200 in the flow chart, in a step 202, the user selects the Edit button 76 and selects a Shaft System Configuration entry for entering shaft system configuration, or forms, parameters and various details to determine the type of components 40 in the shaft system 30. In a step 204, the user enters parameters for bearings, including axial location, bore radius and race width. The bearing locations and sizes are needed to radially locate the outer shaft wall, since the bearings are mounted directly on the shaft system components. The type of bearing such as a roller or a ball, is also selected for each bearing location. The bearing parameters are usually provided by the designers of higher level systems. If the shaft system model 20 cannot be created with the provided bearing parameters, the shaft system designers work with the bearing designers and engine system designers to relocate or resize the bearings.

Still referring to FIGS. 3A to 3E, in a step 206, the configuration of the fan-hub 42 and stub-shaft 44, if any, is selected from a list of configurations. If a stub-shaft 44 is included in the shaft system model 20, a bearing journal may be created on the stub-shaft. In a step 208, the configuration of the aft-hub 46 is selected. The aft-hub 46 may be an integral to the long shaft 64 or may be a separate component 40. The aft-hub 46 may optionally include at least one bearing journal, and the aft-hub's type of seal is selected. The configurations of the stub-shaft 44 and aft-hub 46 were provided by the higher level system designers. Additional parameters are displayed based upon the aft-hub configuration selected.

Continuing with the step 210, model parameters for the aft-hub 46 which may be modified on the Shaft System configuration GUI screen 70 include an axial location for an aft-hub forward oil hole and forward buffer air hole. Default values for these parameters are generated from the previously entered configuration parameters. A common method for selecting numeric values (and for other types of parameter inputs, described hereinafter), is selecting from default values offered to the user on the GUI. The default values are part of the knowledge base of parameters related to the low pressure turbine shaft system model whose values are preprogrammed into the product model software program. Besides default values for parameters or attributes, the knowledge base may also contain constraints on parameter inputs. These constraints and default values may comprise either a single value or range of values. For example, a parameter value may be greater than or less than a certain value. Also, the constraints and defaults may be derived from mathematical equations. A constraint or default value can either by dependent or independent of other parameters.

Continuing with the step 212, product model software program 10 parameters include a name of a directory for output files. Also included are shaft system model 20 parameters such as the minimum thickness of the long shaft 64 and the limit for the inner diameter of the long shaft. The numerical values of the previous two parameters are restricted to a range of values by the rules of the knowledge base.

The configuration of the fan-hub 42, stub-shaft 44 and the type of aft-hub 46 may determine the assembly order of the shaft system 30 since the long shaft 64 must be able to fit within the physical conatraints of all other gas turbine engine components 50 which are already assembled. The shaft system 30 assmebly order dictates the directions of the shaft assembly components 40 and is a key factor for sizing the long shaft 64.

For instance, the configuration of the shaft system model 20 with an integral aft-hub 46, as shown in FIG. 2, requires the insertion of the long shaft 64 from the turbine section 38 of the engine 32 since the aft-hub 46 would not fit within the space limitations caused by the other engine components. If the aft-hub 46 was a separate component and could be joined to the long shaft 64 by a shaft spline coupling or bolts after the long shaft is inserted, the long shaft could be inserted from the compressor section 36 of the gas turbine engine 32. The shaft system 30 must be able to clear the other engine components both during assembly and disassembly. This method assembly are entered into the product product model software program 10 rules, and are automatically applied during the creation of the low pressure turbine shaft system model 20.

Throughout program execution, various GUI screens 70, such as the GUI screen 112 of FIG. 2, guide the user while entering data and information. These GUI screens 70 provide a visual display and graphic depictions of various model 35 configuration and parameter data value selections to the user, allowing the user to select a desired default data value, or to enter a desired data value. Many of the parameters of the low pressure turbine shaft system model 20 may be modified both by manipulating the shaft system model with the mouse 100, and by changing the values of the parameters with the keyboard 98. The present invention contemplates that one of ordinary skill in the art will include someone with skill in designing low pressure turbine shaft system 30 for gas turbine engines 32. Thus, the various attributes or parameters of the low pressure turbine shaft system model 20, together with the values for these parameters, should be readily apparent to someone with such skill. Nevertheless, where appropriate, a discussion of various turbine shaft parameters or attributes, together with the manner of deriving certain default or derived values for these parameters, is provided herein.

Continuing with FIG. 3, in a step 214, the user selects a Shaft System Performance Parameters entry where, in a step 216, the user enters shaft system performance parameters for criteria such as shaft RPM, maximum torque, and design point torque. In addition, in a step 218, the type of materials for the fan-hub 42, long shaft 64 and stub-shaft 44 may be selected from a predefined pulldown list. The types of materials listed fulfill the user's manufacturing and price needs, in addition to design requirements.

Still referring to FIG. 3, in a step 220, the user enters the fan-hub 42 and long shaft 64 spline performance parameters which must be met by the spline coupling between the fan-hub and the stub-shaft 44, and the spline coupling between the stub-shaft and the long shaft. The parameters are limits which are applied separately to the internal spline and external spline of each spline coupling. The parameters include temperature, the maximum axial load, axial load design point, blade loss moments on the major side and minor side of the spline, polar moments on the major side and the minor side of the spline, and steady state moments on the major side and the minor side of the spline.

Continuing with FIG. 3, in a step 222, the user enters performance parameters which must be met for the long shaft 64, or torque tube 64, the stub-shaft 44, and the aft-hub 46. The parameters include temperatures, axial load, blade loss moments and polar moments.

Figure 7:
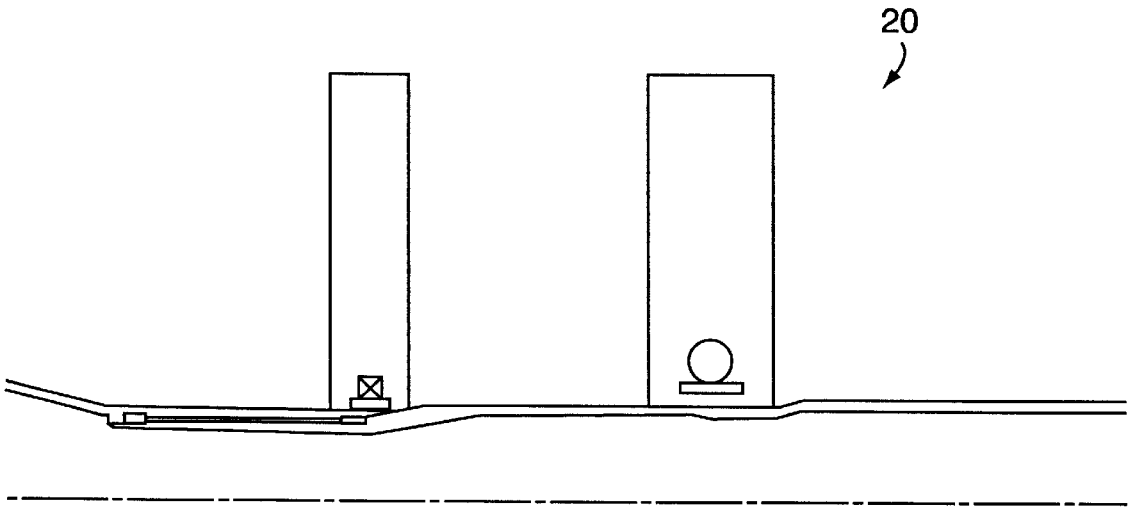
FIG. 7 is a partial cross-section side elevational view of the stub-shaft, spline, and shaft of the model in FIG. 2 including clearance envelopes, as displayed to the user of the product model software program.

As shown in FIGS. 3 and 7 in a step 224, the clearance envelopes are created by the product model software program 10 based upon the configuration parameters relating to the bearings, such as bearing size and location. The clearance envelopes are spaces which cannot be encroached upon during operation or assembly of the gas turbine engine 32, and define the outer diameter of the long shaft 64. Clearance envelopes are often necessary to define space for bearings or other engine hardware. Some clearance envelopes are in existence only during assembly, while other clearance envelopes apply only during operations. The clearance envelopes for operations are often necessary to meet air flow requirements of the gas turbine engine 32.

Referring to FIG. 3, in a step 226, additional clearance envelopes may be added to the shaft system model 20, if necessary. The GUI screen 70 displays the locations and sized of the existing clearance envelopes. The user, in a step 228 enters clearance envelope parameters, such as an axial start of the envelope and an axial end of the envelope. Three parameters may be entered to define the diameter of the clearance envelope; one parameter defines the diameter for the hardware in the envelope, a second parameter for the operations, diameter, or running diameter, of the envelope, and a third parameter defines the assembly diameter of the envelope. The additional clearance envelope may be displayed on the GUI screen 70.

Referring to FIG. 3, after the outer diameter of the shaft is determined, in a step 230, the product model software program 10 determines the optimum shaft 64 thickness by calling a Shaft Stress Optimization program. This is a preexisting program (a legacy program), and is invoked by the product model software program 10. The Shaft Stress Optimization program processes the shaft system model 20 configuration and performance requirement parameters such as the loads, the torque, the material and the temperature at any given diameter of the shaft system 30, to calculate the minimum shaft thickness required to fulfill stress and buckling requirements.

One of the goals embodied in the rules of the product model software program 10 is to create the lightest shaft system 30 which meets overall requirements. Minimizing the cost of the shaft system 30 is one of the overall requirements, in addition to the stress and the buckling requirements. The product model software program 10 allows the user to quickly create different variations of a model compared to the bebefits and advantages of another model by comparing the criteria of wieght,material coat, and manufacutring cost for each model.

Figure 6:
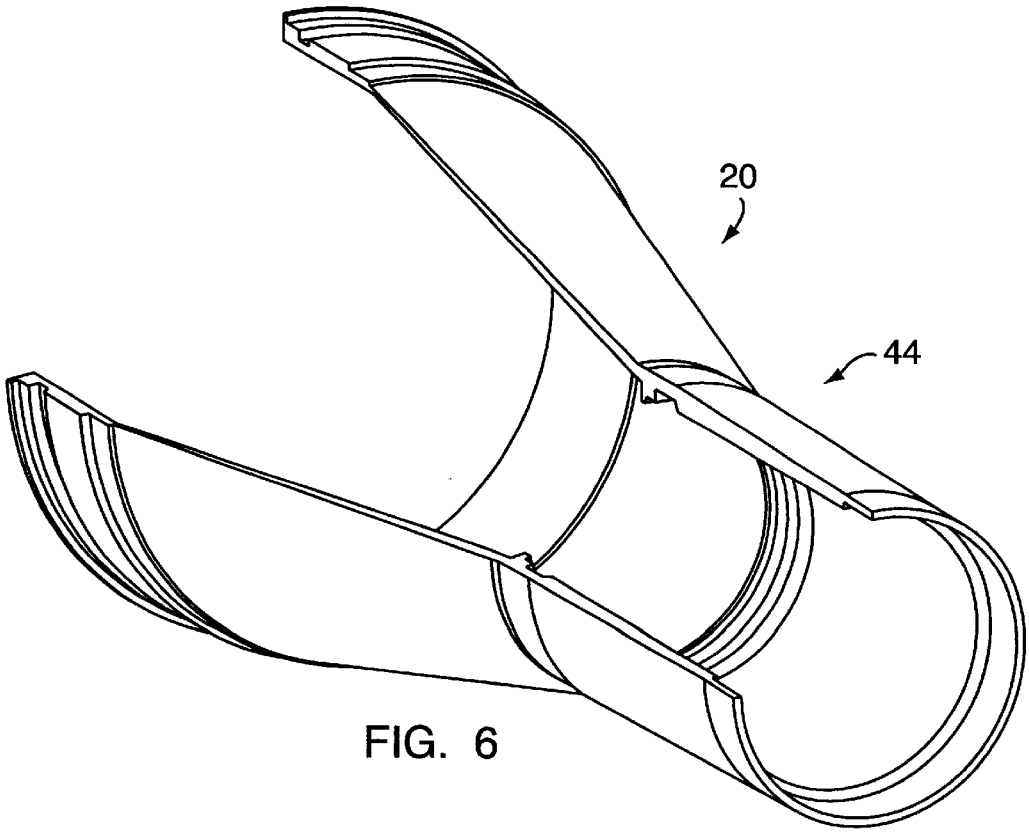
FIG. 6 is a cross-section perspective view of a stub-shaft model of the shaft system model shown in FIG. 2 as displayed to the user of the product model software program.

As shown in FIG. 3, steps 232 to 242, modifications may be made to the individual components of the shaft system model, including the stub-shaft 44, long shaft 64 and aft-hub 46. In the step 232 and referring to FIG. 6, stub-shaft parameters may be modified, including a stub-shaft 44 cone angle, which is defined by the software program 10, and a radius of a fillet between the inner face of the cone section and the a forward coupling, and a radius of a fillet between the outer face of the cone and the forward coupling. In addition, the parameters of a radius of a fillet between the inner face of the cone section and an aft coupling, and a radius of a fillet between the outer face of the cone section and the aft coupling may be modified, within the limits of rule driven defaults and ranges.

Figure 5:
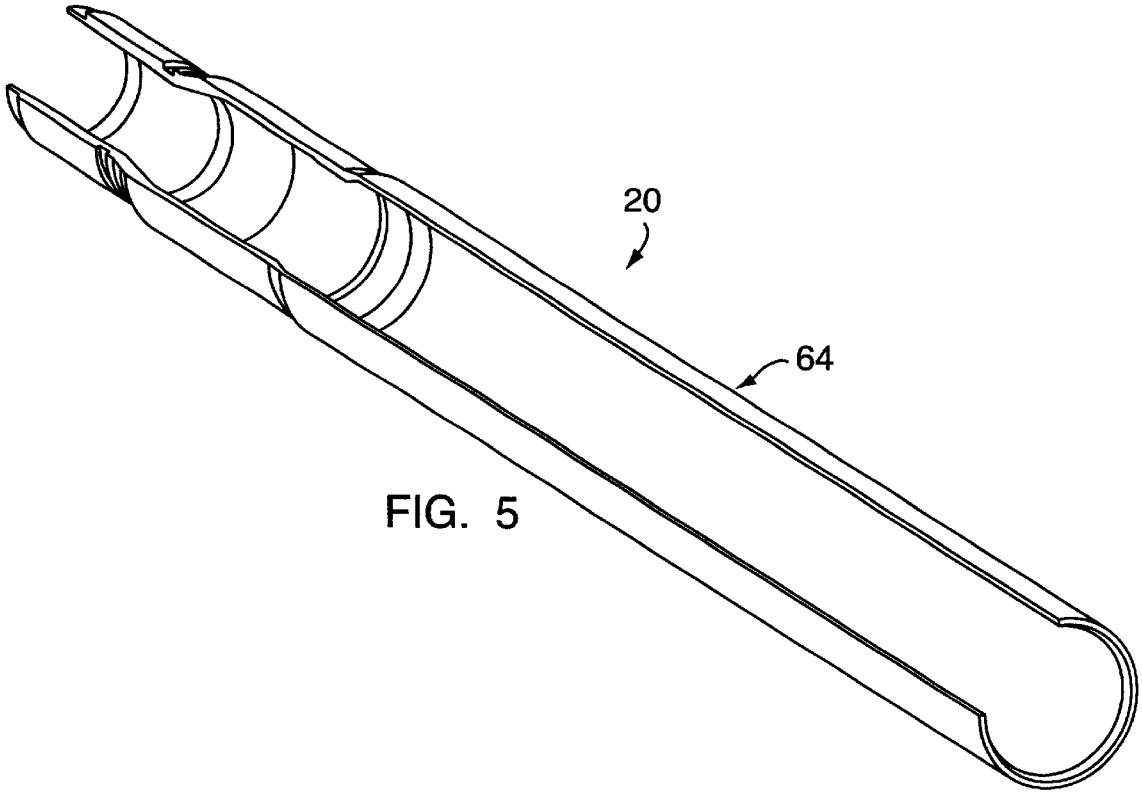
FIG. 5 is a cross-section perspective view of the shaft model of the shaft system model shown in FIG. 2 as displayed to the user of the product model software program.

Referring to FIGS. 3 and 5, in a step 234, the long shaft 64, or the torque tube 64, parameters may be modified. The parameters include an angle for the transitions of an outer diameter of the long shaft 64. In addition, the long shaft transitions at the forward end of the long shaft 64 and at the aft end of the long shaft, for both the outer diameter and inner diameter of the long shaft, may be modified.

It should be understood that these shaft system parameters, and their order of entry into the program, are purely exemplary. Instead, as should be readily apparent to one of ordinary skill in the art, other shaft system characteristics may have their dimensions input in various orders by the user.

Referring to FIGS. 2 and 3, in a step 236, aft-hub parameters may be modified. In a step 238, parameters in a forward shaft section of the aft-hub 46 (not shown) which may be modified include a number of buffer air holes and forward oil holes, an oil hole clearance, and the transition angle between the forward shaft section of the aft-hub and an aft shaft section of the aft-hub. The aft-hub's 46 required number of hours of fatigue life may be set. In a step 240, parameters in an aft shaft section of the aft-hub 46 which may be modified include an inner diameter for the aft shaft section, a number of aft oil holes for the aft-hub, an aft oil hole diameter, a radial step for the aft oil hole, and a height of an aft bearing shoulder.

Continuing with FIGS. 2 and 3, in a step 242, aft-hub 46 hub 160 parameters which may be modified include a number of bolt circles 162 for the hub, and a radius, number of bolts, and bolt diameter in each bolt circle. Additional parameters which may be modified include a seal type for a bearing compartment cover, a thickness for the base of the hub 160, a clearance to a front face of the hub, 35 and a location on the hub to which the low pressure turbine 60 attaches. Other modifiable parameters include a type of snap for a seal runner, an axial length for the seal runner, a thickness of the hub 160 at a third bolt circle, and whether to include a snap at the location in which the low pressure turbine 60 is attached to the hub.

Similar to the other major structural features of the low pressure turbine shaft system model 20, the product model software program 10 of the present invention stores (as part of its knowledge base for the low pressure turbine shaft system model) a number of default values for various attributes of the shaft system 30. These attributes include various thickness, widths, lengths, radii, and orientations.

Referring to FIGS. 3 and 7, in a step 246, parameters defining the spline couplings 48 in the shaft system 30 may be modified. Spline couplings 48 exist between the fan-hub 42 and either the long shaft 64 or, if present, the stub-shaft 44, and between the stub-shaft and the long shaft. A spline coupling 48 may attach the the long shaft 64 and the aft-hub 46, or the aft-hub may be integral with the long shaft. The product model software program 10 is not limited as to method of assembly or joining, such as spline couplings, since components may be joined in other manner, such as bolting without departing from the scope of the claimed invention.

The spline coupling parameters, such as orientation of the major snap, the spline shoulder configuration, and the location of a transfer of torque for the internal spline and the external spline, and many other parameters, are described in a patent application, U.S. Ser. No. 09/520,085, filed on Mar. 7, 2000, entitled "Method of a Spline Coupling Design System", which is hereby incorporated by reference. The Spline Coupling Design System is included within and utilized by the product model software program 10 to define spline coupling parameters for the shaft system model 20. The options and limits for the spline couplings 48 are established by the overall shaft system 30 configuration and performance requirements.

Continuing with FIG. 3, in a step 248, in order to create and view the low pressure turbine shaft system model 20, the user selects the Create button 78 and chooses the type of display, such as a two-dimensional model, a solid three-dimensional model, or a solid view with a segment of the model removed for internal viewing. The user may also select which section of the shaft system 30 to display, including the aft-hub 46, the long shaft 64, the stub-shaft 44, if present, or the entire shaft system. The selected model is displayed on a GUI screen 70, and may be printed or saved.

The ICAD system creates a valid, parametric, three-dimensional, geometric model 20 of the shaft system, including components such as a spline coupling, using the user-input data verified against the knowledge base of configuration-dependent parameter relationships and constraints stored in the product model software program of the present invention. The ICAD system inherently contains a number of common geometric primitives (e.g., a cylinder) that the product model software program utilizes in creating the model. These primitives are inherent in the sense that they reside in the ICAD system apart from the product model software programs. As such, the primitives do not have to be pre-programmed into the product model software program. However, the product model software program 10 contains the rules that relate a primitive or combination of primitives to a geometrical feature of the panel.

Still referring to FIG. 3, the ICAD system allows the user to perform various types of engineering analyses on the model design to assess various performance features of the design. As shown in step 252 of FIG. 3, a weight report may be generated upon the low pressure turbine shaft system model 20. In this way, the user can assess the weight of the design chosen for the low pressure turbine shaft system model 20. These calculations are based on the default and modified shaft system parameters and shaft system geometry, such as the geometric representation of the shaft system, previously entered into the product model software program 10, and the shaft system material and shaft component material, such as hub material, entered in the weight analysis program. The user selects the Analysis button 70 and chooses the weight report. The weight for each component is generated and reported for each component of the shaft system model 20, as well as for the total shaft system.

In further accord with the present invention, the product model software program 10 allows the user to modify any portion of the geometry of the low pressure turbine shaft system model 20. This can be done any time after the model 20 geometry has been created by the ICAD system. If the user is not satisfied with the results of the weight analysis report or any other features of the low pressure turbine shaft system model 20, the user can return to any step in the design process to modify the model. When changing the various low pressure turbine shaft system features, as previously noted, the program advises the user if any design rules have been violated such that the low pressure turbine shaft systems may not be able to satisfy design requirements. The user may make the desired changes to the model in the steps 202 to 246. The resulting visual model may be viewed at any time and further modified, if desired. Once the user is satisfied with the resulting low pressure turbine shaft system model 20, a design report, various non-parametric Unigraphics CAD input files, Ansys Interface files and interface data files for other applications are created. The program then ends in a step 266.

Referring to FIG. 3, in a step 256, the user selects the Info button 82 and chooses a design report. The product model software program 10 creates the design report which is a text file that lists the various parameters relating to the physical features or elements of the low pressure turbine shaft system model 20 along with the values assigned to those parameters by the program (including both user-selected parameter values and pre-programmed default parameter values). The report lists geometric information and performance information about the low pressure turbine shaft system model 20 in terms of parameter values for each feature. The design report is a comprehensive record of the shaft system model 20 and, as in a step 258, can be printed, viewed or saved to disk.

Referring to FIG. 3, in a step 260, the user selects the File button 74 and chooses Export to specify the directory and filenames for creating part files to input to the Unigraphics CAD system to create a non-parametric model. The Unigraphics CAD system may be implemented within the same workstation 92 as that of the ICAD system. The user selects specific geometric representations of the low pressure turbine shaft system model 20 to output, such as all two-dimensional or three-dimensional model parts, or only a particular component, such as the long shaft 64 or spline coupling. The program then creates the above-specified non-parametric Unigraphics CAD input files for the selected sections of the low pressure turbine shaft system model 20. The non-parametric model created in the CAD system may not be easily altered, and so it is of limited use. However, drawings based on the model are useful, along with other functions of the Unigraphics system which are not provided by the ICAD system, such as combining the geometric representations of the shaft system with other gas turbine engine components 50.

Continuing to refer to FIG. 3, in a step 262, the user may select the creation of Ansys Interface files that are output from the ICAD system for input into an Ansys spline coupling stress analysis computer program. These ICAD system files contain spline coupling parameters and values from the low pressure turbine shaft system model 20 parameter data, and are output by the product model software program 10 of FIG. 3. The Ansys Interface files are used to create a parametric model for finite element modeling to detect stresses in spline couplings designed for use in the shaft system. The information the user receives from the Ansys computer program may be used to modify the parameters of the spline couplings in the low pressure turbine shaft system model 20.

Still referring to FIG. 3, in a step 264, the user can select and generate input files for other software program applications, such as providing basic information on the fan spline 114 for a rotor design application, and providing file listings containing a parametrical listing of each element of the low pressure turbine shaft. The file listing is an output from a knowledge-based engineering system. After the required low pressure turbine shaft system model has been created and output, in a step 266, the user exits the product model software program 10.

Although the present invention has been shown and described with respect to the detailed embodiments thereof, it will be understood by those skilled in the art that various changes in the form and detail thereof, such as applying the present invention to the design of other than aeronautic equipment, and implementing the present invention with other computer software besides the aforementioned expert system, may be made without departing from the claimed invention.

What is claimed is:

1. A method of designing a low pressure turbine shaft, comprising the steps of:

creating signals representing a low pressure turbine shaft knowledge base of information having a plurality of design rule signals with respect to a corresponding plurality of parameter signals of associated elements of a low pressure turbine shaft, wherein the knowledge base comprises at least one data value signal for each one of the plurality of design rule signals;

entering a desired data value signal for a selected one of the plurality of parameter signals of an associated element of the low pressure turbine shaft;

comparing the entered desired data value signal for the selected one of the plurality of parameter signals with the corresponding at least one data value signal in the low pressure turbine shaft knowledge base for the corresponding one of the plurality of design rule signals; and creating signals representative of a geometric representation of the selected one of the plurality of parameter signals of the associated element of the low pressure turbine shaft if the result of the step of comparing is such that the entered desired data value signal for the selected one of the plurality of parameter signals is determined to have a first predetermined relationship with respect to the corresponding at least one data value signal in the knowledge base for the selected one of the plurality of design rule signals, and wherein one of the plurality of the parameter signals represents a clearance envelope definition for modifying parameter signals representing an outer diameter of the low pressure turbine shaft.

2. The method of claim 1, wherein the step of creating the signals representative of a geometric representation of the selected one of the plurality of parameter signals of the associated element of the low pressure turbine shaft further comprises the step of updating signals representing the model of the low pressure turbine shaft with the selected one of the plurality of parameter signals of the associated element of the low pressure turbine shaft.

3. The method of claim 1, further comprising the step of modifying the entered desired data value signal for the selected one of the plurality of parameter signals if the result of the step of comparing is such that the entered desired data value signal for the selected one of the plurality of parameter signals is determined to have a second predetermined relationship with respect to the corresponding at least one data value signal in the low pressure turbine shaft knowledge base for the selected one of the plurality of design rule signals.

4. The method of claim 3, further comprising the steps of:

comparing the modified data value signal for the selected one of the plurality of parameter signals with the corresponding at least one data value signal in the low pressure turbine shaft knowledge base for the corresponding one of the plurality of design rule signals; and creating signals representative of a second geometric representation of the selected one of the plurality of parameter signals of the associated element of the low pressure turbine shaft if the result of the step of comparing is such that the modified data value signal for the selected one of the plurality of parameter signals is determined to be of the first predetermined relationship with respect to the corresponding at least one data value signal in the low pressure turbine shaft knowledge base for the corresponding one of the plurality of design rule signals.

5. The method of claim 1, further comprising the step of storing the signals representative of the created low pressure turbine shaft knowledge base of information.

6. The method of claim 1, further comprising the step of displaying the signals representative of the created geometric representation of the selected one of the plurality of parameter signals of the associated element of the low pressure turbine shaft.

7. The method of claim 1, wherein one of the plurality of the parameter signals represents one of a plurality of configurations of the low pressure turbine shaft system.

8. A method of designing a low pressure turbine shaft, comprising the steps of:

creating signals representing a low pressure turbine shaft knowledge base of information having a plurality of design rule signals with respect to a corresponding plurality of parameter signals of associated elements of a low pressure turbine shaft, wherein the knowledge base comprises at least one data value signal for each one of the plurality of design rule signals;

entering a desired data value signal for a selected one of the plurality of parameter signals of an associated element of the low pressure turbine shaft;

comparing the entered desired data value signal for the selected one of the plurality of parameter signals with the corresponding at least one data value signal in the low pressure turbine shaft knowledge base for the corresponding one of the plurality of design rule signals;

creating signals representative of a geometric representation of the selected one of the plurality of parameter signals of the associated element of the low pressure turbine shaft if the result of the step of comparing is such that the entered desired data value signal for the selected one of the plurality of parameter signals is determined to have a first predetermined relationship with respect to the corresponding at least one data value signal in the knowledge base for the selected one of the plurality of design rule signals; and minimizing signals representing the desired data values of the thickness at any diameter of the low pressure turbine shaft while fulfilling performance requirement parameter signals.

9. The method of claim 1, further comprising the step of analyzing the signals representative of the geometric representation of the selected one of the plurality of parameter signals of the associated element of the low pressure turbine shaft.

10. The method of claim 9, wherein the step of analyzing the signals representative of the geometric representation of the selected one of the plurality of parameter signals of the selected element of the low pressure turbine shaft further comprises the step of performing a weight analysis on the signals representative of the geometric representation of the selected one of the plurality of parameter signals of the associated element of the low pressure turbine shaft.

11. The method of claim 1, wherein the step of creating the signals representative of the geometric representation of the selected one of the plurality of parameter signals of the associated element of the low pressure turbine shaft further comprises the step of creating signals representative of a model of a spline coupling.

12. The method of claim 1, wherein the at least one data value signal for each one of the plurality of design rule signals in the knowledge base comprises a numerical value.

13. The method of claim 1, wherein the at least one data value signal for each one of the plurality of design rule signals in the knowledge base comprises a range of values.

14. The method of claim 1, wherein the step of entering a desired data value signal for a selected one of the plurality of parameter signals of an associated element of the low pressure turbine shaft comprises the steps of:

making available at least one data value signal for each one of the plurality of parameter signals of the associated element of the low pressure turbine shaft; and selecting a desired data value signal for the selected one of the plurality of parameter signals of the associated element of the low pressure turbine shaft from the made available at least one data value signal for each one of the plurality of parameter signals of the associated element of the low pressure turbine shaft.

15. The method of claim 14, wherein the step of making available at least one data value signal for each one of the plurality of parameter signals of the associated element of the low pressure turbine shaft comprises the step of providing a visual display containing signals representative of a graphic depiction of the at least one data value signal for each one of the plurality of parameter signals of the associated element of the low pressure turbine shaft.

16. The method of claim 1, further comprising the step of providing a file listing of a selected one or more of the plurality of parameter signals of the low pressure turbine shaft, wherein the file listing includes at least one of the entered desired data value signals for each one of the corresponding plurality of parameter signals of the low pressure turbine shaft, wherein the file listing represents a parametrical listing of each element of the signals representing the model of the low pressure turbine shaft.

17. The method of claim 16, wherein the step of providing a file listing of a selected one or more of the plurality of parameter signals of the low pressure turbine shaft further comprises the step of providing the file listing as an output from a knowledge-based engineering system.

18. A computerized system for designing a low pressure turbine shaft, comprising:

a low pressure turbine shaft knowledge base including a plurality of design rule signals for generating low pressure turbine shaft configuration signals, wherein each of the design rule signals has a first relationship with at least one of a plurality of design parameter signals;

input means for receiving a design parameter value signal corresponding to one of the plurality of design parameter signals;

evaluation means for comparing the design parameter value signal with the plurality of design rule signals;

adjustment means for modifying low pressure turbine shaft configuration signals utilizing the design parameter value signal and the plurality of design rule signals; and creation means for generating signals representative of a geometric representation of the low pressure turbine shaft configuration signals, and wherein the design rule signals include maximizing the design parameter signals representing diameters of the low pressure turbine shaft relative to the design parameter signals representing clearance specifications.

19. The computerized system of claim 18, wherein one of the plurality of the design parameter signals represents one of a plurality of forms of the low pressure turbine shaft.

20. A computerized system for designing a low pressure turbine shaft, comprising:

a low pressure turbine shaft knowledge base including a plurality of design rule signals for generating low pressure turbine shaft configuration signals, wherein each of the design rule signals has a first relationship with at least one of a plurality of design parameter signals;

input means for receiving a design parameter value signal corresponding to one of the plurality of design parameter signals;

evaluation means for comparing the design parameter value signal with the plurality of design rule signals;

adjustment means for modifying low pressure turbine shaft configuration signals utilizing the design parameter value signal and the plurality of design rule signals;

creation means for generating signals representative of a geometric representation of the low pressure turbine shaft configuration signals; and means for minimizing the design parameter values signals representing the thickness at any diameter of the low pressure turbine shaft while fulfilling performance requirement parameter signals.

21. The computerized system of claim 18, further including:

cautionary means for generating a warning signal if the parameter value signal does not satisfy the plurality of the design rule signals; and means for displaying the warning signal.

22. A computerized system for designing a low pressure turbine shaft, comprising:

a low pressure turbine shaft knowledge base including a plurality of design rule signals for generating low pressure turbine shaft configuration signals, wherein each of the design rule signals has a first relationship with at least one of a plurality of design parameter signals;

input means for receiving a design parameter value signal corresponding to one of the plurality of design parameter signals;

evaluation means for comparing the design parameter value signal with the plurality of design rule signals;

adjustment means for modifying low pressure turbine shaft configuration signals utilizing the design parameter value signal and the plurality of design rule signals;

creation means for generating signals representative of a geometric representation of the low pressure turbine shaft configuration signals;

shaft material parameter signals received from the input means;

hub material parameter signals received from the input means; and means for generating weight signals for the low pressure turbine shaft utilizing shaft material parameter signals and hub material parameter signals and low pressure turbine shaft configuration signals.

23. The computerized system of claim 18, wherein the design parameter signals include performance parameter signals for generating analysis signals of the low pressure turbine shaft configuration signals, and manufacturing parameter signals for establishing manufacturing constraints and preferences for the low pressure turbine shaft configuration signals.

24. The method of claim 8, wherein the step of creating the signals representative of a geometric representation of the selected one of the plurality of parameter signals of the associated element of the low pressure turbine shaft further comprises the step of updating signals representing the model of the low pressure turbine shaft with the selected one of the plurality of parameter signals of the associated element of the low pressure turbine shaft.

25. The method of claim 8, further comprising the step of modifying the entered desired data value signal for the selected one of the plurality of parameter signals if the result of the step of comparing is such that the entered desired data value signal for the selected one of the plurality of parameter signals is determined to have a second predetermined relationship with respect to the corresponding at least one data value signal in the low pressure turbine shaft knowledge base for the selected one of the plurality of design rule signals.

26. The method of claim 25, further comprising the steps of:

comparing the modified data value signal for the selected one of the plurality of parameter signals with the corresponding at least one data value signal in the low pressure turbine shaft knowledge base for the corresponding one of the plurality of design rule signals; and creating signals representative of a second geometric representation of the selected one of the plurality of parameter signals of the associated element of the low pressure turbine shaft if the result of the step of comparing is such that the modified data value signal for the selected one of the plurality of parameter signals is determined to be of the first predetermined relationship with respect to the corresponding at least one data value signal in the low pressure turbine shaft knowledge base for the corresponding one of the plurality of design rule signals.

27. The method of claim 8, further comprising the step of storing the signals representative of the created low pressure turbine shaft knowledge base of information.

28. The method of claim 8, further comprising the step of displaying the signals representative of the created geometric representation of the selected one of the plurality of parameter signals of the associated element of the low pressure turbine shaft.

29. The method of claim 8, wherein one of the plurality of the parameter signals represents one of a plurality of configurations of the low pressure turbine shaft system.

30. The method of claim 8, further comprising the step of analyzing the signals representative of the geometric representation of the selected one of the plurality of parameter signals of the associated element of the low pressure turbine shaft.

31. The method of claim 30, wherein the step of analyzing the signals representative of the geometric representation of the selected one of the plurality of parameter signals of the selected element of the low pressure turbine shaft further comprises the step of performing a weight analysis on the signals representative of the geometric representation of the selected one of the plurality of parameter signals of the associated element of the low pressure turbine shaft.

32. The method of claim 8, wherein the step of creating the signals representative of the geometric representation of the selected one of the plurality of parameter signals of the associated element of the low pressure turbine shaft further comprises the step of creating signals representative of a model of a spline coupling.

33. The method of claims 8, wherein the at least one data value signal for each one of the plurality of design rule signals in the knowledge base comprises a numerical value.

34. The method of claim 8, wherein the at least one data value signal for each one of the plurality of design rule signals in the knowledge base comprises a range of values.

35. The method of claim 8, wherein the step of entering a desired data value signal for a selected one of the plurality of parameter signals of an associated element of the low pressure turbine shaft comprises the steps of:

making available at least one data value signal for each one of the plurality of parameter signals of the associated element of the low pressure turbine shaft; and selecting a desired data value signal for the selected one of the plurality of parameter signals of the associated element of the low pressure turbine shaft from the made available at least one data value signal for each one of the plurality of parameter signals of the associated element of the low pressure turbine shaft.

36. The method of claim 35, wherein the step of making available at least one data value signal for each one of the plurality of parameter signals of the associated element of the low pressure turbine shaft comprises the step of providing a visual display containing signals representative of a graphic depiction of the at least one data value signal for each one of the plurality of parameter signals of the associated element of the low pressure turbine shaft.

37. The method of claim 8, further comprising the step of providing a file listing of a selected one or more of the plurality of parameter signals of the low pressure turbine shaft, wherein the file listing includes at least one of the entered desired data value signals for each one of the corresponding plurality of parameter signals of the low pressure turbine shaft, wherein the file listing represents a parametrical listing of each element of the signals representing the model of the low pressure turbine shaft.

38. The method of claim 37, wherein the step of providing a file listing of a selected one or more of the plurality of parameter signals of the low pressure turbine shaft further comprises the step of providing the file listing as an output from a knowledge-based engineering system.

39. The computerized system of claim 20, wherein one of the plurality of the design parameter signals represents one of a plurality of forms of the low pressure turbine shaft.

40. The computerized system of claim 21, further inducing:

cautionary means for generating a warning signal if the parameter value signal does not satisfy the plurality of the design rule signals; and means for displaying the warning signal.

41. The computerized system of claim 20, wherein the design parameter signals include performance parameter signals for generating analysis signals of the low pressure turbine shaft configuration signals, and manufacturing parameter signals for establishing manufacturing constraints and preferences for the low pressure turbine shaft configuration signals.

42. The computerized system of claim 22, wherein one of the plurality of the design parameter signals represents one of a plurality of forms of the low pressure turbine shaft.

43. The computerized system of claim 22, further including:

cautionary means for generating a warning signal if the parameter value signal does not satisfy the plurality of the design rule signals; and means for displaying the warning signal.

44. The computerized system of claim 22, wherein the design parameter signals include performance parameter signals for generating analysis signals of the low pressure turbine shaft configuration signals, and manufacturing parameter signals for establishing manufacturing constraints and preferences for the low pressure turbine shaft configuration signals.

* * * * *